US005130085A

United States Patent [19]

Tendo et al.

[11] Patent Number: 5,130,085

[45] Date of Patent: Jul. 14, 1992

[54] HIGH AL AUSTENITIC HEAT-RESISTANT STEEL SUPERIOR IN HOT WORKABILITY

[75] Inventors: Masayuki Tendo; Mikio Yamanaka, both of Sagamihara; Masamitsu Tsuchinaga, Kitakyushu; Harumi Tsuboi, Hikari, all of Japan

[73] Assignee: Nippon Steel Corporation, Tokyo, Japan

[21] Appl. No.: 499,443

[22] PCT Filed: Oct. 22, 1988

[86] PCT No.: PCT/JP88/01078

§ 371 Date: Aug. 22, 1990

§ 102(e) Date: Aug. 22, 1990

[87] PCT Pub. No.: WO90/04658

PCT Pub. Date: Mar. 5, 1990

[30] Foreign Application Priority Data

Apr. 24, 1987 [JP] Japan ..... 62-99964

[51] Int. Cl.[5] ..... C22C 38/06; C22C 38/40

[52] U.S. Cl. ..... 420/40; 420/79; 420/584.1

[58] Field of Search ..... 420/40, 43, 79, 584

[56] References Cited

FOREIGN PATENT DOCUMENTS

| | | | |
|---|---|---|---|
| 93661 | 11/1983 | European Pat. Off. | 420/40 |
| 2414561 | 8/1979 | France . | |
| 48-79120 | 10/1973 | Japan . | |
| 49-32685 | 9/1974 | Japan . | |
| 55-38025 | 10/1980 | Japan . | |
| 60-262945 | 12/1985 | Japan | 420/40 |

*Primary Examiner*—Deborah Yee

*Attorney, Agent, or Firm*—Wenderoth, Lind & Ponack

[57] ABSTRACT

High Al austenitic steels are particularly susceptible to deterioration of the hot workability and suffer from severe cracking during hot working, with working becoming impossible in some cases. The present invention remarkably improves the hot workability by strictly limiting the impurities in the steel, in particular the S, O, Mg, Pb, Bi, etc. That is, the present invention reduces the S and O by adding one or more of Ca, Y, and REM to satisfy the range of $-50<(S)+(O)-0.8\times(Ca)-0.2\times(Y)-0.1\times(REM)<30$ (unit: ppm) and further limits the Mg to no more than 100 ppm, the Pb to no more than 10 ppm, and the Bi to no more than 5 ppm. According to the present invention, it is possible to obtain a high Al austenitic heat-resistant steel superior in hot workability which is free from occurrence of edge cracks, surface flaws, and other surface defects during hot rolling, hot casting, etc.

8 Claims, 2 Drawing Sheets

HIGH AL AUSTENITIC HEAT-RESISTANT STEEL SUPERIOR IN HOT WORKABILITY

1. Field of the Invention

The present invention relates to a high Al austenitic heat-resistant steel having a superior resistance to oxidation at high temperatures and resistance to corrosion at high temperatures and further an excellent hot workability.

2. Background of the Relatevent Art

It Al is added in an alloy and an oxide film comprised mostly of $Al_2O_3$ is formed on the surface in a high temperature oxidizing atmospher, extremely excellent oxidation resistance is displayed, it is known. For example, Fe-Cr-Al alloy steels are used as members for sintering equipment and other members exposed to atmospheres of up to 1200° C. However, the above steels are basically low in strenght at the high temperature due to the ferrite phase and have therefore been limited in range of application as they could not be used at positions requiring strength at high temperatures.

On the other hand, Fe-Ni-Cr or Ni-Cr and other austenitic heat-resistant steels are superior in high temperature strength and mechanical properties at ordinary temperatures, so have been widely used as high temperature members, but these steels have $Cr_2O_3$ formed on their surfaces at high temperatures and this film is used to maintain excellent oxidation resistance, so at 1000° to 1100° C. or more, where the film begins to varporize as $CrO_3$, the oxidation resistance rapidly deteriorates. Further, the spalling resistance of the oxide film is also poor and in the case of continued heating or erosion, there is a large tendency of weight decrease of the material due to oxidation.

Numerous attempts have been made up to now to add Al to the above steels so as to improve the austenitic heat-resistant steels. However, if the amount of Al added is small, no $Al_2O_3$ oxide film is formed on the alloy surface and the film which is formed is mainly composed of a spinel oxide film of Fe, Ni, and Cr. This oxide film is porous and relatively easily permeated by oxygen and nitrogen, so the speed of oxidation of the matrix just under the oxide film is high and further AlN precipitates below the same in a block form, so the Al is consumed and there is little effect of the addition of the same. To form a uniform $Al_2O_3$ film on the surface of an austenitic alloy and bring out a superior oxidation resistance, it is necessary to added a minimum of 4.0 percent in terms of weight in the alloy. This is described, for example, in Japanese Examined Patent Publication (Kokoku) No. 55-43498, etc.

However, if Al is added in an austenitic steel, the hot workability rapidly deteriorates and serious cracking occurs during not rolling, hot forgoing, hot extrusion, and other working. Further, there are cases where working is impossible. This cracking occurs at the grain boundaries near the surface and propagates along the grain boundaries to develop into large cracks. This is because the Al is in solid solution in the austenite phase, so the integranular deformation resistance in the hot state significantly rises and the intergranular strenght falls relatively, to increase the susceptibility to cracking, and further the NiAl intermetallic compounds precipitate in the grains and at the grain boundaries during solidification or hot deformation, so the intergranular ductility falls.

To improve the hot workability of such an austenitic stainless steel containing a high concentration of Al, Jpanese Examined Patent Publication No. 55-43498 and Japanese Exampled Patent Publication No. 56-11302 discloses, based on the way of thinking of conventional conventional stainless steels, to precipitate some δ-ferrite in the austenite phase during solidification and to add La, Ce, and other rare earth elements so as to improve the hot workability, but high Al austenitic stainless steel, as mentioned above, is fundamentally much more susceptible to cracking under hot working compared with conventional stainless steel and with just the precipitation of δ-ferrite or addition of rare earth elements, sufficient hot workability cannot be obtained, and unless the concentration of the impurity elements causing deterioration of the hot workability is strictly controlled, it is impossible to prevent cracking occurring during hot working. Further, Japanese Unexamined Patent Publication No. 60-262945 proposes to hot roll the steel at a temperature range of from 1000° C. to 1200° C., but unless the concentration of minute impurities is accurately controlled, even if the hot rolling method is specially tailored, edge cracks, flaws, etc. will appear in large numbers at the early part of the hot rolling and thus the effect cannot be said to be sufficient.

SUMMARY OF THE PRESENT INVENTION

The present invention provides a high Al austenitic heat-resistant steel which is superior in oxidation resistance and excellent in hot workability. The constituent components of the present invention will be explained below. The first aspect of the present invention includes 0.01 to 0.2% of C, 1 percent or less of Si, 2 percent or less of M, 15 to 25 percent of Ni, 12 to 25 percent of Cr, and over 4 percent to 6 percent of Al and further contains one or more of Ca, Y, and a REM so as to satisfy the range shown by the following formula (1), with the remainder being Fe and unavoidable impurities.

In the formula, REM means La, Ce, and other rare earth elements (hereinafter referred to as REM).

$$-50<(S)+(O)-0.8\times(Ca)-0.2\times(Y)-0.1\times(REM)<30 \text{ (unit; ppm)} \quad \ldots (1)$$

That is, the present invention is characterized by improvement of the hot workability by addition of one or more of Ca, Y, and REM so as to satisfy the above formula (1) to an austenitic steel containing the above range of components.

The addition of Ca, REM, etc. to a usual austenitic stainless steel or superalloy raises the closeness of adherence of the oxide film created by the high temperatures and improves the heat resistance and, simultaneously, also improves the hot workability, as is a known fact. This is because the S and O which segregate at the grain boundaries to lower the intergranular ductility are reduced at the refining stage and also becausse the elements remaining in the steel ingot are strongly bonded and fixed and their segregation unstably at the grain boundaries and reduction of the intergranular strength are suppressed.

Even in an austenitic heat-resistant steel containing over 4 percent to 6 percent by weight of Al, the hot workability changes depending on the content of the S and O impurities, but the steel is more sensitive than normal stainless steel to this. Therefore, the content of the S and O in the steel must be reduced as much as possible and further Ca, Y, and REM which reduced and fix the S and O added. Further, it is industrially difficult to stably realize a content of S and O not causing cracking during hot working without the addition of Ca, Y, and REM and the cost also rises, so the addition of Ca, Y, and REM may be considered industrially essential.

In this way, Ca, Y, and REM are important additive elements for improving the hot workability of high Al austenitic heat-resistant steels and are most effective elements not only for removing the S and O in the molten steel, but also for fixing the S and O segregating at the grain boundaries during cooling and thus suppressing deterioration of the hot workability.

However, in a high Al austenitic heat-resistant steel, even if Ca, Y, and REM are added, the hot workability is not necessarily staisfied in some cases, it was learned. The present inventors delved into the reason for this and discovered that when the amount of the above elements added is too excessive, the hot workability conversely deteriorates and that there is a suitagble range for the S and O amount.

That is, in the austenitic heat-resistant steel of the range of composition of the present invention, since the susceptibility to cracking at hot working is fundamentally high, it is necessary to strictly suppress those elements which segregate at the grain boundaries and reduced the ductility.

That is, the hot workability rapidly deteriorates if the amount of Ca, Y, and REM added is insufficient compared with the S and O contents and the hot workability rapidly deteriorates if the amount of the Ca, Y, and REM added is too excessive compared with the S and O contents. This is because Ca, Y, and REM are large in atomic radii and do enter solid solution in the steel much at all, so ecessively added atoms segregate at the grain boundaries in an unstable state and the intergranular ductility is reduced. That is, excessive Ca, Y, and REM act as impurity elements having a detrimental effect on the hot workability. Therefore, the upper limit on the amount of Ca, Y, and REM added is determined with relation to the S and O contents.

That is, in the above formula (1), if the value of the difference between the content of S and O and the content of the Ca, Y, and REM is over 30 ppm, the content of the Ca, Y, and REM is too little compared with the S and O, the effect of addition of the same is reduced, and the hot workability is rapidly deteriorated by the effects of the unfixed S and O.

Therefore, to prevent insufficient addition, the upper limit in the above formula (1) is limited to 30 ppm.

On the other hand, if an excessive amount is added so that the difference between the two becomes over −50 ppm, the oxidation resistance is further improved, but unstable Ca, Y, and REM segregate at the grain boundaries and the intergranular ductility is reduced, so conversely the hot workability is deteriorated. To prevent this excessive addition, the lower limit of the above formula (1) is limited to −50. The above relationship is shown in FIG. 1. That is, FIG. 1 shows the relationship of the above formula (1) and the mean score of a hot impact test. To enable normal hot working without occurrence of edge cracks etc., the mean score of the hot impact test must be made 2 or less. To satisfy this condition, the upperr limit of formula (1) is made 30 and the lower limit −50. When performing severe hot working such as continuous hot rolling where the reduction ratio or the stree rate is high, it is preferable that the mean score of the hot impact test in FIG. 1 be 1 or less.

Note that the effective range of addition for fixing the harmful S and O is 5 to 150 ppm of Ca, 10 to 750 ppm of Y, and 50 to 150 ppm of REM. The coefficients of the elements in the above formula (1) are found experimentally by evaulating the hot workability of steel ingots changed in the contents of the various elements within the range of compositioon of the present invention and making the effects of the elements the same.

Further, S and O are preferably extremely low from the viewpoint of the hot workability. In steels like the steel of the present invention where a large amount of Al is contained, the steel is sensitive to the contents of S and O. This is because the S and O segregate at the grain boundaries during solidification or cooling to lower the intergranular ductility, so the steel has a higher intergranular deformation resistance at high temperatures than conventional stainless steels and is more suceptible to intergranular cracking.

On the other hand, as mentioned above, the amounts of addition of Ca, Y, and REM should be reduced as much as possible within the range of effectiveness. Therefore, the value of (S)+(O) is preferably held below 100 ppm.

The second aspect of the present invention features, in addition to the features of the first aspect, restricting the allowable amount of Mg, which remarkably impairs the hot workability, in the above range of composition to 100 ppm.

In conventional general use stainless steels or superalloys, the addition of Mg is effective for improving the hot workability, but the present inventions discovered that in austenitic stainless steels containing over 4.0 percent to 6 percent by weight of Al, there is not effect of addition and conversely there is a stron tendency to cause deterioration of the hot workability and that the allowable content is extremely low. The inventors confirmed this allowable amount. Austenistic steels containing a high concentration of Al deteriorate in hot workability due to the Mg impurities because the Mg does not enter solid solution much at all in the austenite phase but concentrates at a high concentration at the grain boundaries along with the Al to reduce the intergranular ductility. In austenitic steels not containing Al, the Mg impurities do not mix in the molten steel much at all and the amount of Mg impurities remaining in the steel after solidification is extremely low. However, in austenitic steels containing high concentrations of Al, there is a good chance that the Al material, or the Al in the steel, will reduce the MgO in the furnace material or the slag and this will enter the molten steel. That is, in general industrial use Al materials contain several hundred ppm as impurities. Further, Mg is an alloy element added to Al, so when, using recycled Al materials, it may be considered further that a high concentration of Mg impurities is contained. Also, at near 1500° C., the temperature of the molten steel, the thermodynamic stabilities of $Al_2O_3$ and MgO are substantially the same, so the following equilibrium stands and the Al in the steel reduces the brick or slag containing MgO which enters the molten steel.

$$3MgO+2Al=Al_2O_3+3Mg$$

Further, the Mg impurities entering in from the materials or the furnace materials and slag exist stably in the molten steel since the thermodynamic equilibrium is maintained. However, Mg does not enter solid solution much at all in the austenitic solid phase, so concentrates during the solidification at the grain, boundaries or in the NiAl intermetallic compounds and casues deterioration of the hot workability. Therefore, the determination of the allowable amount of the Mg is important for ensuring the hot workability of austenitic stainless steel containing over 4 percent to 6 percent by weight of Al and making production possible.

FIG. 2 shows the relationship between the content of Mg and the mean score of the hot impact test. From this figure, it is understood that if the content of the Mg is over 100 ppm, the hot workability becomes difficult. To prevent fine edge cracks, flasw, etc. during hot rolling, it is preferable that the content of Mg be suppressed to 50 ppm and the mean score of the hot impact test be made 1 or less.

The third aspect of the present invention features, in addition to the features of the second aspect, the strict suppression of the contents of Pb and Bi, which remarkably impair the hot workability, in the above range of composition to not more than 10 ppm and 5 ppm, respectively. Pd and Bi are elmeents which impair the hot workability even in normal austenitic stainless steels, and austenitic heat-resistant steels containing over 4 percent of 6 percent by weight of Al are extremely sensitive to them. These elements do not enter solid solution much in the steel and segregate at the grain boundaries to remarkably reduce the intergranular ductility. The steel of the present invention inherently is very susceptible to cracking in the hot state and to prevent cracking the contents of Pb and Bi must be strictly limited to no more than 10 ppm and 5 ppm, respectively. The allowable amounts are much severer than with conventional stainless steels. Pb impurities are included in the industrial use iron alloys used are materials for the steel and are generally present in concentrations of tens of ppm. Further, they are contained in tens of ppm in the recycled Al materials as well in some cases. Further, while the content of Bi is less than Pb, Bi is inevitably included in the industrial use iron alloys. Therefore, these elements have to be positively reduced in amount or else it is impossible to keep them below the above allowable amounts. To reduce the amounts of Pb and Bi, it is effective to strictly select materials with low contents of these elements and to perform refining in a reduced pressure atmosphere.

In this way, Pb and Bi which enter the steel as impurities cause extreme deterioration of the hot workability of the steel of the present invention. FIG. 3 shows the relationship between the contents of Pb and Bi and the mean score of the hot impact test. From the figure, it is understood that the allowable amounts of Pb and Bi and 10 ppm and 5 ppm, respectively. To prevent fine edge cracks, flaws, etc. during hot rolling, it is preferable that the Pb and Bi be suppressed to 5 ppm and 3 ppm or less and that the means score of the hot impact test be made 1 or less.

Next, the δ-ferrite produced during solidification with the range of composition of the present invention will be explained.

The δ-ferrite phase includes a larger amount of Al than the austenite phase, so the concentration of Al in the austenite phase is reduced and the precipitation of Ni-Al intermetallic compounds in the grain boundaries or in the grains during cooling is delayed. Further, there is an effect of absorption of S, O, and other impurities, so no edge cracks occur even during more severe hot working with large reduction ratios or stress rates. Further, there is an effect of suppression of high temperature cracking during welding. However, if the δ-ferrite phase is precipitated 10 percent or more, the cold workability or the high temperature strength are deteriorated, so the amount of precipitation is preferably made less than 10 percent. Note that the amount of precipitation was measured using a commerically available ferrite meter. The amount of the δ-ferrite precipitating during solidification may be estimated by the following formula from the chemical composition. However, the range of application is the range of composition described in the claims:

$$\delta\text{-Ferr}\ (\%) = 3\times(Cr+1.5\times Si+8\times Al-24.7)-2.8\times(Ni+0.5\times Nn+30\times C+16.5\times N)-19.8$$ (units of components are precentages by weight) . . . (2)

if the δ-Ferr (%) found by formula (2) is less than 10 percent, the measured value of the δ-ferrite precipitating during actual solidification becomes less than 10 percent. However, even if less than 0 percent in formula (2), if over −15 percent, a δ-ferrite phase precipitates during actual solidification, so to make less than 10 percent of a δ-ferrite phase precipitated, the value given by formula (2) should be made over −15 percent and less than 10 percent.

Next, an explanation will be made of components of the present invention other than those mentioned above.

C is an element unavoidably included in steel, but if the content is too high, large amounts of chromium carbides and δ-phases will precipitate during use at 600° to 900° C., making the material brittle, and further the high temperature deformation resistance will rise and the hot workability will deteriorate. Therefore, the upper limit is made 0.2 percent.

Si is an element unavoidably included in steel and in general has the effect of improving the oxidation resistance, but in the steel of the present invention which has an $Al_2O_3$ film formed on the surface, there is almost no effect by its addition and conversely if the content of Si is over 1 percent, the formation of the $Al_2O_3$ film is inhibited. Therefore, the upper limit of the Si content is made 1 percent.

Mn is an element unavoidably included in steel, but if the content exceeds 2 percent, the formation of the $Al_2O_3$ film is inhibited, so the upper limit is made 2 percent.

Ni is a basic element for making the steel of the present invention an austenitic steel. Due to the content of Cr and Al, 15 percent or more of Ni is necessary. However, if the content of Ni exceeds 35 percent, there is remarkable precipitation of Ni-Al intermetallic compounds and hot working becomes difficult. Therefore the range of Ni is made 15 to 35 percent.

Cr, like Al, is an essential element for obtainoing a high degree of oxidation resistance. If the content of Cr is less than 12 percent, abnormal oxidation occurs in the early used and no $Al_2O_3$ film is formed on the surface of the steel for maintaining the oxidation resistance. Cr is an element which plays an important role in the formation of the $Al_2O_3$ film in the initial stages of use. However, if the content of the Cr exceeds 25 percent, a 94 -phase precipitates during use and embrittlement easily occurs and, further, it is necessary to add large amounts of Ni for formation of the austenite, promoting the precipitation of Ni-Al intermetallic compounds. Therefore, the content of Cr is made 12 to 25 percent.

Al is the most important element for forming the $Al_2O_3$ film on the surface of the steel of the present invention and for maintaining the heat resistance. To ensure the stable formation of the $Al_2O_3$ film, the content of Al must be over 4 percent. If 4 percent of less, the $Al_2O_3$ film is not formed, and oxide comprised mainly of Cr is formed, and the oxidation resistance drops remarkably compared with the case where an $Al_2O_3$ film is formed. However, when the content of the Al is over 6 percent, the deformation resistance in the hot state further rises and Ni-Al intermetallic compounds remarkably precipitate in the grains and the the grain boundaries, so hot working becomes de factor impossible even with the strict control of the impurities described in the present invention.

Other impurity elements having an effect on the hot workability are Zn, Sb, Sn, and As, but these elements do not impair the hot workability in concentrations unavoidably present in normal austenitic stainless steels. When included in excess, however, the deterioration of the hot workability is remarkable, so the melting method is preferably one which gives sufficient consideration to the molten material and slag composition so that these do not enter.

Further, to further improve the creep strength or the oxidation resistance, it is possible to add Mo, W, Co, Ti, Nb, or Zr, but if these elements are added in excess, the hot deformation resistance will rise and the hot workability will be deteriorated.

DESCRIPTION OF THE PREFERRED EMBODIMENTS

Figure 1:
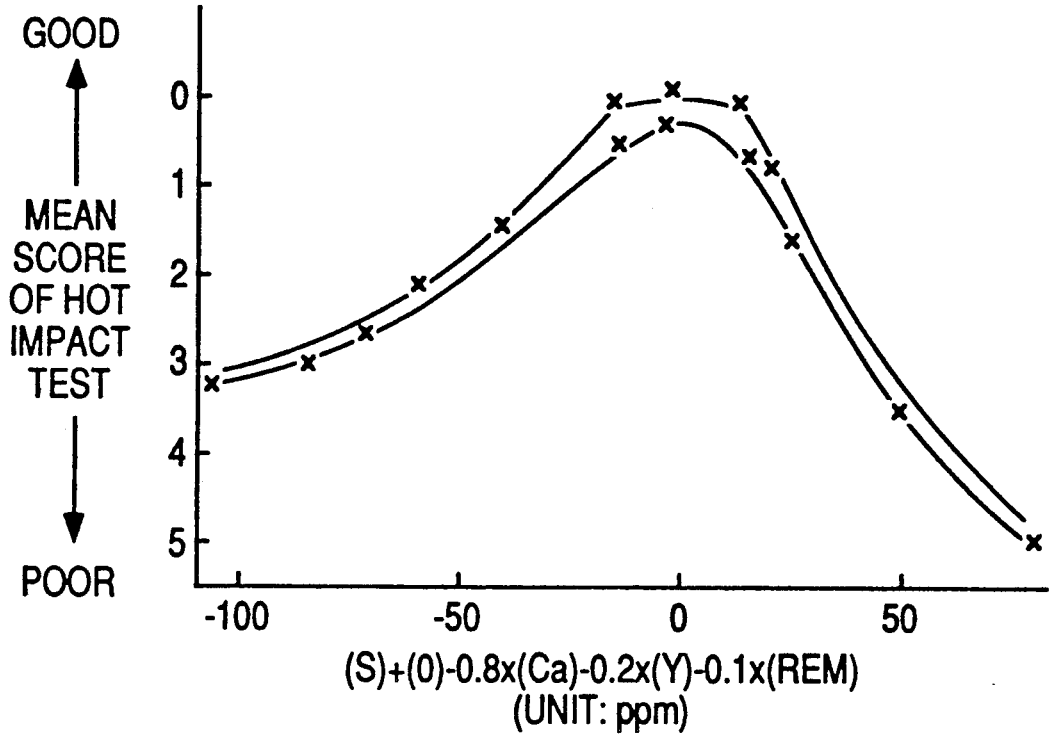
FIG. 1 is a graph showing the relationship between formal (1) in the present invention and the mean score in the hot impact test, the points in the figure being data obtained from steels of Mg≦50 ppm, Pb≦5 and Bi≦3 ppm. At the top of the vertical axis, the hot workability is good and at the bottom the hot workability is poor.
Figure 2:
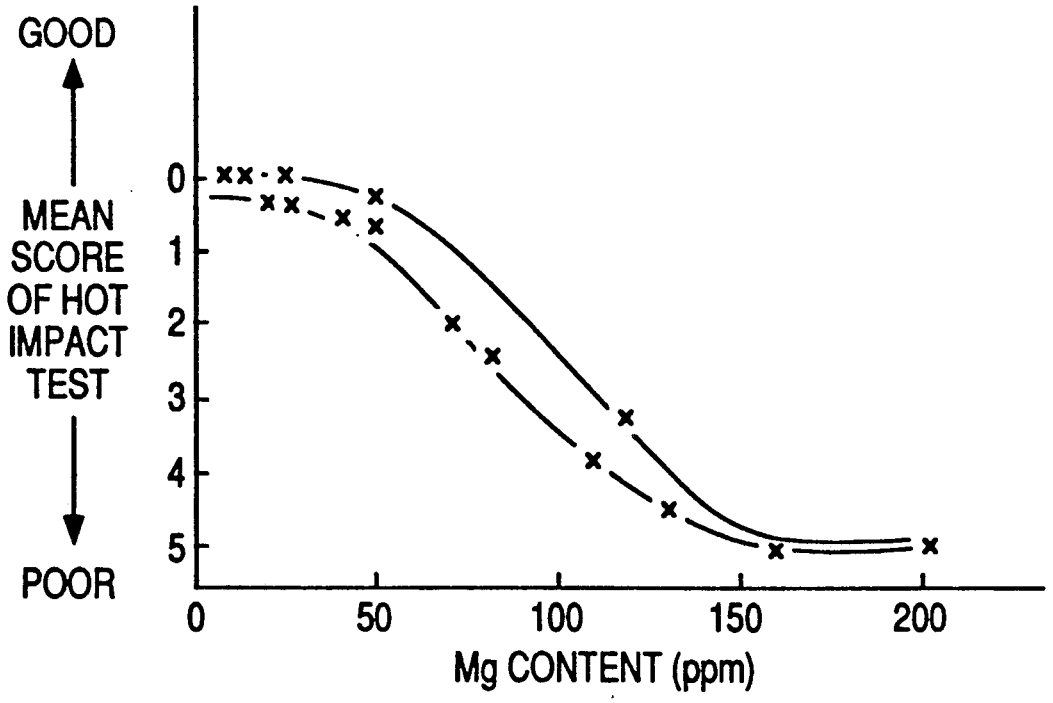
FIG. 2 is a graph showing the relationship between the content of Mg in the steel and the mean score of the hot impact test, the points in the figure being data obtained from steel ingots which satisfy formula (1) and have Pb≦5 ppm and Bi≦3 ppm.
Figure 3:
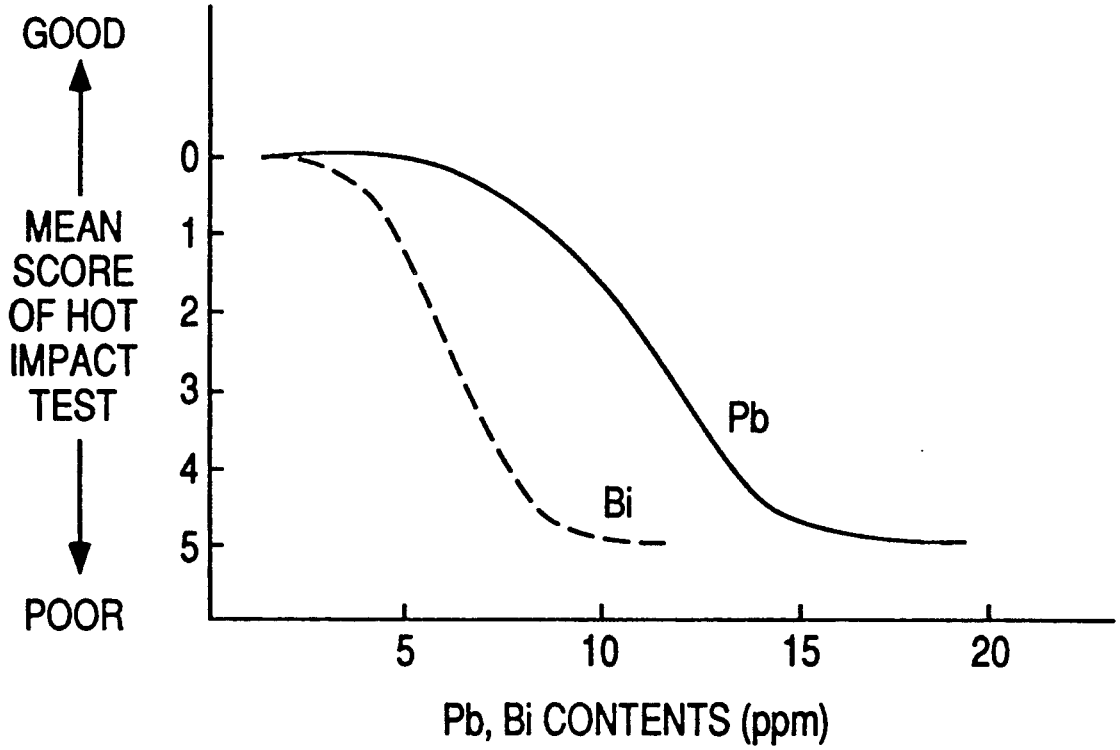
FIG. 3 is a graph showing the relationship between the contents of Pb and Bi in steel and the mean score of the hot impact test, the graph being prepared based on data obtained from steel ingots which staisfy formula (1) and have Mg≦50 ppm.

Next, the advantageous effects of the invention will be shown specifically by example.

EXAMPLES

The steels of the compositions shown in Nos. 1 to 24 to Table 1 were melted in a vacuum or in the atmosphere (melted, then refined by AOD), with those melted in vacuum formed into ingots and those melted in the atmosphere continuously cast.

All steel ingots had contents of Zn and Sn of 200 ppm or less each and Sb and As of 100 ppm or less each—contents of the degree contained in normal austenitic stainless steel.

The hot workability was evaluated by a hot rolling experiment on the steel ingots produced by the same method as a hot impact test. In the hot impact test, unnotched Carpy test pieces were cut out from 5 mm below the surface of the steel ingots, heated to 1250° C., and held at that temperature for 10 minutes, then air cooled to a predetermined impact temperature and an inpact given. The impact temperatures were 900°, 1000°, 1050°, 1100°, 1150°, and 1200° C. The evaluations were made by ranking the steels in five stages based on the state of the cracking as shown in Table 2, and the mean value of the results at all the impact temperatures was used. The larger the means score, the poorer the ductility at a high temperature and the worse the hot workability. For no edge cracks to occur at normal hot rolling, the value must be no more than 2. In the hot rolling experiment, steel ingots with shaved surfaces were held at 1250° C. for one hour, then reduced a total of 90 percent by five passes and the state of the edge cracks examined.

The results of the evaluation of the hot workability are shown in Table 3. From the results it will be seen that if the range of composition of the present invention is satisfied, it is possible to obtain austenitic heat-resistant steel superior in hot workability. Further, it was learned that steels which satisfy the above formula (2) and have less than 10 percent of the steel phase precipitated have a mean score in the hot impact test of no more than 1 and are further superior in hot workability.

Part of the steel ingots of Table 1 were subjected to hot rolling, cold rolling, annealing, and surface grinding for an oxidation test. The size of the test pieces was 1 $mm^t \times 20\ mm^w \times 50\ mm^L$. The test pieces were inserted in an atmosphere of 1200° C. and automobile engine exhaust gases and held there for 30 minutes, then air cooled for 10 minutes, with this intermittent heating repeated 200 times, then the change in weight was measured. The results are shown in Table 4. From the results, it was learned that the steel of the present invention has a superior oxidation resistnace.

INDUSTRIALLY USEFULNESS

The present invention provides an austenitic heat-resistant steel continaing Al which is superior in heat resistant at high temperatures and further is particularly superior in hot workability, being free from cracking and flasws during hot rolling, hot forging, hot extrusion, and other hot working, so has industrially practical effects in many areas.

TABLE 1

| Test No. | | Chemical Composition of Samples (wt %)-No. 1 | | | | | | |
|---|---|---|---|---|---|---|---|---|
| | | C | Si | Mn | P | S | Ni | Cr |
| 1 | Steels of invention | 0.055 | 0.51 | 0.45 | 0.019 | 0.0015 | 25.14 | 17.14 |
| 2 | | 0.051 | 0.55 | 0.44 | 0.017 | 0.0006 | 24.39 | 16.15 |
| 3 | | 0.049 | 0.54 | 0.45 | 0.017 | 0.0014 | 24.47 | 16.14 |
| 4 | | 0.108 | 0.83 | 0.44 | 0.016 | 0.0006 | 24.96 | 16.71 |
| 5 | | 0.048 | 0.50 | 0.50 | 0.017 | 0.0040 | 25.68 | 17.86 |
| 6 | | 0.059 | 0.53 | 0.59 | 0.015 | 0.0009 | 27.02 | 17.28 |
| 7 | | 0.119 | 0.51 | 0.53 | 0.018 | 0.0022 | 30.58 | 21.06 |
| 8 | | 0.057 | 0.25 | 0.49 | 0.018 | 0.0015 | 19.20 | 15.05 |
| 9 | | 0.052 | 0.34 | 0.52 | 0.019 | 0.0014 | 31.05 | 17.20 |
| 10 | | 0.054 | 0.55 | 1.21 | 0.018 | 0.0011 | 24.45 | 16.29 |
| 11 | | 0.036 | 0.18 | 0.85 | 0.017 | 0.0018 | 22.51 | 16.32 |

TABLE 1-continued

| | | | | | | | | |
|---|---|---|---|---|---|---|---|---|
| 12 | | 0.095 | 0.76 | 0.58 | 0.022 | 0.0011 | 24.93 | 16.85 |
| 13 | Comparative steels | 0.051 | 0.49 | 0.49 | 0.017 | 0.0030 | 25.55 | 17.65 |
| 14 | | 0.051 | 0.49 | 0.50 | 0.017 | 0.0055 | 25.60 | 17.95 |
| 15 | | 0.047 | 0.50 | 0.51 | 0.017 | 0.0015 | 25.68 | 17.83 |
| 16 | | 0.051 | 0.49 | 0.50 | 0.017 | 0.0010 | 26.01 | 17.85 |
| 17 | | 0.049 | 0.51 | 0.54 | 0.020 | 0.0025 | 25.97 | 16.74 |
| 18 | | 0.037 | 0.38 | 0.62 | 0.017 | 0.0019 | 22.38 | 16.50 |
| 19 | | 0.051 | 0.51 | 0.54 | 0.020 | 0.0008 | 25.87 | 17.15 |
| 20 | | 0.053 | 0.86 | 0.53 | 0.020 | 0.0010 | 26.23 | 17.20 |
| 21 | | 0.053 | 0.50 | 0.53 | 0.021 | 0.0005 | 26.03 | 17.25 |
| 22 | | 0.050 | 0.65 | 0.48 | 0.017 | 0.0012 | 25.70 | 17.00 |
| 23 | | 0.103 | 0.82 | 0.54 | 0.018 | 0.0021 | 24.91 | 16.81 |
| 24 | | 0.059 | 0.31 | 0.45 | 0.017 | 0.0012 | 24.84 | 16.96 |
| 25 | | 0.051 | 0.31 | 0.45 | 0.016 | 0.0013 | 25.41 | 17.24 |
| 26 | | 0.051 | 0.31 | 0.45 | 0.016 | 0.0007 | 25.37 | 17.15 |
| 27 | | 0.052 | 0.74 | 0.91 | 0.018 | 0.0028 | 20.35 | 25.21 |
| 28 | | 0.005 | 0.42 | 1.31 | 0.010 | 0.0008 | 31.92 | 20.53 |

Chemical Composition of Samples (wt %)-No. 2

| Test No. | | Al | Ca | Ce | La | Y | Mg | O |
|---|---|---|---|---|---|---|---|---|
| 1 | Steels of invention | 4.79 | 0.0020 | | | | 0.0027 | 0.0013 |
| 2 | | 4.71 | 0.0035 | | | | 0.0008 | 0.0006 |
| 3 | | 5.17 | 0.0032 | | | | 0.0010 | 0.0012 |
| 4 | | 4.68 | 0.0031 | | | | 0.0040 | 0.0005 |
| 5 | | 5.31 | 0.0117 | | | | 0.0030 | 0.0014 |
| 6 | | 4.85 | 0.0010 | | | | 0.0010 | 0.0013 |
| 7 | | 5.53 | | 0.036 | | | 0.0013 | 0.0013 |
| 8 | | 4.30 | | 0.015 | | | 0.0022 | 0.0019 |
| 9 | | 4.82 | 0.0009 | 0.002 | | | 0.0040 | 0.0024 |
| 10 | | 4.82 | | | 0.026 | | 0.0013 | 0.0021 |
| 11 | | 4.63 | | | | 0.014 | 0.0009 | 0.0017 |
| 12 | | 4.91 | 0.0032 | | | | 0.0011 | 0.0021 |
| 13 | Comparative steels | 5.11 | 0.0003 | | | | 0.0015 | 0.0022 |
| 14 | | 5.08 | 0.0002 | | | | 0.0014 | 0.0025 |
| 15 | | 5.17 | 0.0385 | | | | 0.0009 | 0.0024 |
| 16 | | 5.21 | 0.0117 | | | | 0.0025 | 0.0011 |
| 17 | | 5.00 | | 0.084 | | | 0.0019 | 0.0021 |
| 18 | | 4.65 | | | | 0.058 | 0.0011 | 0.0012 |
| 19 | | 5.02 | 0.0032 | | | | 0.0110 | 0.0008 |
| 20 | | 5.06 | 0.0025 | | | | 0.0130 | 0.0010 |
| 21 | | 5.00 | 0.0031 | | | | 0.0162 | 0.0009 |
| 22 | | 5.10 | 0.0036 | | | | 0.0198 | 0.0018 |
| 23 | | 4.81 | 0.0055 | | | | 0.0024 | 0.0015 |
| 24 | | 4.86 | 0.0040 | | | | 0.0010 | 0.0021 |
| 25 | | 4.84 | 0.0020 | | | | 0.0015 | 0.0018 |
| 26 | | 4.84 | 0.0010 | | | | 0.0020 | 0.0015 |
| 27 | | | | | | | | 0.0035 |
| 28 | | 0.46 | | | | | | 0.0026 |

Chemical Composition of Samples (wt %)-No. 3

| Test No. | | Pb | Bi | PV | δ-Ferr | Melting method | Steel type |
|---|---|---|---|---|---|---|---|
| 1 | Steels of invention | <0.0002 | <0.0002 | 12.0 | −1.1 | VIM | |
| 2 | | <0.0002 | " | −16.0 | 3.2 | VIM | |
| 3 | | 0.0003 | " | 0.4 | 7.6 | VIM | |
| 4 | | 0.0003 | " | −13.8 | −7.5 | VIM | |
| 5 | | 0.0003 | 0.0003 | −39.6 | 12.1 | VIM | |
| 6 | | 0.0002 | <0.0002 | 14.0 | −4.9 | VIM | |
| 7 | | <0.0002 | " | −1.0 | 7.7 | VIM | |
| 8 | | 0.0003 | 0.0002 | 19.0 | −3.8 | VIM | |
| 9 | | 0.0004 | <0.0002 | 24.8 | −17.2 | VIM | |
| 10 | | 0.0002 | " | 6.0 | −1.8 | VIM | |
| 11 | | 0.0003 | " | 7.0 | −0.4 | VIM | |
| 12 | | <0.0002 | " | 6.4 | −1.0 | AOD | |
| 13 | Comparative steels | 0.0002 | <0.0002 | 49.6 | 7.2 | VIM | |
| 14 | | 0.0002 | 0.0002 | 78.4 | 7.3 | VIM | |
| 15 | | <0.0002 | <0.0002 | −269.0 | 9.3 | VIM | |
| 16 | | 0.0002 | " | −72.6 | 8.9 | VIM | |
| 17 | | <0.0002 | " | −59.0 | 0.9 | VIM | |
| 18 | | <0.0002 | " | −85.0 | 2.1 | VIM | |
| 19 | | 0.0002 | 0.0002 | −9.6 | 2.7 | VIM | |
| 20 | | 0.0002 | 0.0002 | 0.0 | 4.2 | VIM | |
| 21 | | 0.0004 | 0.0002 | −10.8 | 1.8 | VIM | |
| 22 | | 0.0005 | 0.0003 | 1.2 | 5.3 | AOD | |
| 23 | | 0.0012 | 0.0003 | −8 | −3.7 | VIM | |
| 24 | | 0.0018 | 0.0002 | 1 | −0.4 | VIM | |
| 25 | | 0.0002 | 0.0006 | 15 | −1.0 | VIM | |
| 26 | | 0.0002 | 0.0010 | 14 | −1.1 | VIM | |
| 27 | | | | | | AOD | SUS310S |

TABLE 1-continued

| 28 | VIM | In800 |
|---|---|---|

Note 1:
PV = (S) + (O) − 0.8 × (Ca) − 0.2 × (Y) − 0.1 × (REM) (unit: ppm)
Note 2:
δ-Ferr = 3 × (Cr + 1.5 × Si + 8 × Al − 24.7) − 2.8 × (Ni + 0.5 × Mn + 30 × C + 16.5 × N) − 19.8 (units of components are percentages by weight)
Note 3:
VIM in melting method means vacuum melting and AOD means atmospheric melting and AOD refinement.
Note 4:
Contents of N in Steels are all ≦200 ppm or less.

TABLE 2

| Hot Impact Test Evaluation | |
|---|---|
| Score | State of cracking after impact test |
| 0 | No cracking |
| 1 | Fine cracking |
| 2 | Cracking of less than one-half width of test piece |
| 3 | Cracking of more than one-half width of test piece |
| 4 | Cracking of more than one-half thickness of test piece |
| 5 | Fracturing into two pieces |

TABLE 3

| Results of Evaluation of Hot Workability | | |
|---|---|---|
| Test No. | Hot impact test evaluation | Results of hot rolling experiment (state of hot rolled sheet) |
| Steel of invention | | |
| 1 | 0.0 | No edge cracks or surface flaws |
| 2 | 0.0 | No edge cracks or surface flaws |
| 3 | 0.1 | No edge cracks or surface flaws |
| 4 | 0.5 | No edge cracks or surface flaws |
| 5 | 1.4 | No edge cracks or surface flaws |
| 6 | 0.6 | No edge cracks or surface flaws |
| 7 | 0.3 | No edge cracks or surface flaws |
| 8 | 0.8 | No edge cracks or surface flaws |
| 9 | 1.5 | No edge cracks or surface flaws |
| 10 | 0.2 | No edge cracks or surface flaws |
| 11 | 0.4 | No edge cracks or surface flaws |
| 12 | 0.0 | No edge cracks or surface flaws |
| Comparative steel | | |
| 13 | 3.5 | Deep edge cracks |
| 14 | 5.0 | Severe edge cracks and surface flaws |
| 15 | 4.2 | Deep edge cracks |
| 16 | 2.7 | Numerous deep edge cracks |
| 17 | 2.1 | Numerous deep edge cracks |
| 18 | 3.0 | Deep edge cracks |
| 19 | 3.8 | Deep edge cracks |
| 20 | 4.5 | Severe edge cracks and surface flaws |
| 21 | 5.0 | Severe edge cracks and surface flaws |
| 22 | 5.0 | Severe edge cracks and surface flaws |
| 23 | 2.9 | Deep edge cracks |
| 24 | 5.0 | Severe edge cracks and surface flaws |
| 25 | 2.5 | Numerous deep edge cracks |
| 26 | 5.0 | Severe edge cracks and |

TABLE 3-continued

| Results of Evaluation of Hot Workability | | |
|---|---|---|
| Test No. | Hot impact test evaluation | Results of hot rolling experiment (state of hot rolled sheet) |
| | | surface flaws |

TABLE 4

| Results of Oxidation Test | | |
|---|---|---|
| Test No. | Increase in weight in atmospheric oxidation test (mg/cm$^2$) | Increase in weight in automobile engine exhaust gases (mg/cm$^2$) |
| Steel of invention | | |
| 1 | +1.24 | +4.50 |
| 7 | +0.95 | +2.32 |
| 10 | +1.32 | +4.22 |
| Comparative steel | | |
| 20 | −23.0 | −181.0 |
| 21 | −13.2 | −93.2 |

We claim:

1. A high Al austenitic heat-resistant steel superior in hot workability comprising, by weight percent, up to 0.2 percent of C, up to 1 percent of Si, up to 2 percent of Mn, 15 to 35 percent of Ni, 12 to 25 percent of Cr, over 4 percent to 6 percent of Al, and at least one of Ga, Y, and REM in a range shown by the following formula, with the balance being Fe and unavoidable impurities:

$-50<(S)+(O)-0.8\times(Ca)-0.2\times(Y)-0.1\times(REM)<30$ (unit: ppm)

2. A high Al austenitic heat-resistant steel superior in hot workability comprising, by weight percent, up to 0.2 percent of C, up to 1 percent of Si, up to 2 percent of Mn, 15 to 35 percent of Ni, 12 to 25 percent of Cr, over 4 percent to 6 percent of Al, and at least one of Ca, Y, and REM in a range shown by the following formula, with any Mg contained in the steel being limited to no more than 100 ppm, with the balance being Fe, and unavoidable impurities:

$-50<(S)+(O)-0.8\times(Ca)-0.2\times(Y)-0.1\times(REM)<30$ (unit: ppm)

3. A high Al austenitic heat-resistant steel superior in hot workability comprising, by weight percent, up to 0.2 percent of C, up to 1 percent of Si, up to 2 percent of Mn, 15 to 35 percent of Ni, 12 to 12 percent of Cr, over 4 percent to 6 percent of Al, and at least one of Ca, Y, and REM in a range shown by the following formula, with the Mg being limited to no more than 100 ppm, the Pb to no more than 10 ppm, and the Bi to no more than 5 ppm, with the balance being Fe and unavoidable impurities:

$-50<(S)+(O)-0.8\times(Ca)-0.2\times(Y)-0.1\times(REM)<30$ (unit: ppm)

4. A heat-resistant steel as set forth in claim 2, wherein the said high Al austenitic heat-resistant steel has no more than 50 ppm of Mg.

5. A heat-resistant steel as set forth in claim 3, wherein said high Al austenitic heat-resistant steel has no more than 50 ppm of Mg, no more than 5 ppm of Pb, and no more than 3 ppm of Bi.

6. A heat-resistant steel as set forth in claim 1, wherein in said high Al austenitic heat-resistant steel, less than 10 percent of a δ-ferrite phase during solidification is precipitated by satisfying the following formula:

$$-15<3\times(Cr+1.5\times Si+8\times Al-24.7)-2.8\times(Ni+0.5\times Mn+30\times C+16.5\times N)-19.8<10$$

(units of components are percentage by weight)

7. A heat-resistant steel as set forth in claim 3, wherein in said high Al austenitic heat-resistant steel, less than 10 percent of a δ-ferrite phase during solidification is precipitated by satisfying the following formula:

$$-15<3\times(Cr+1.5\times Si+8\times Al-24.7)-2.8\times(Ni+0.5\times Mn+30\times C+16.5\times N)-19.8<10$$

(units of components are percentages by weight)

8. A heat-resistant steel as set forth in claim 5, wherein in said high Al austenitic heat-resistant steel, less than 10 percent of a δ-ferrite phase during solidification is precipitated by satisfying the following fomrula:

$$-15<3\times(Cr+1.5\times Si+8\times Al<24.7)-2.8\times(Ni+0.5\times Mn+30\times C+16.5\times N)-19.8<10$$

(units of components are percentages by weight)

* * * * *